US009912078B2

(12) United States Patent
Jidhage et al.

(10) Patent No.: US 9,912,078 B2
(45) Date of Patent: Mar. 6, 2018

(54) COMPACT MULTI-COLUMN ANTENNA

(75) Inventors: Henrik Jidhage, Molndal (SE); Anders Ek, Hisings Backa (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 871 days.

(21) Appl. No.: 13/882,727

(22) PCT Filed: Nov. 1, 2010

(86) PCT No.: PCT/EP2010/066568
§ 371 (c)(1),
(2), (4) Date: Apr. 30, 2013

(87) PCT Pub. No.: WO2012/059122
PCT Pub. Date: May 10, 2012

(65) Prior Publication Data
US 2013/0214983 A1 Aug. 22, 2013

(51) Int. Cl.

| | |
|---|---|
| ***H01Q 21/29*** | (2006.01) |
| ***H01Q 1/24*** | (2006.01) |
| ***H01Q 21/06*** | (2006.01) |
| ***H01P 11/00*** | (2006.01) |
| ***H01Q 9/20*** | (2006.01) |
| ***H01Q 21/26*** | (2006.01) |

(52) U.S. Cl.
CPC ..... *H01Q 21/293* (2013.01); *H01P 11/00* (2013.01); *H01Q 1/246* (2013.01); *H01Q 9/20* (2013.01);
(Continued)

(58) Field of Classification Search
CPC ..... H01Q 9/20; H01Q 1/246; H01Q 21/062; H01Q 21/26; H01Q 21/293
(Continued)

(56) References Cited

U.S. PATENT DOCUMENTS 4,131,896 A 12/1978 Miller
2005/0179610 A1* 8/2005 Le ..... H01Q 1/246 343/797
(Continued)

FOREIGN PATENT DOCUMENTS

DE 20 2004 008 770 U1 8/2004
WO 2004070878 A1 8/2004

OTHER PUBLICATIONS

Alois Krischke, Karl Rothammel: "Rothammels Antennenbuch" 2001, DARC Verlag; Baunatal, XP002654424, ISBN: 3-88692-033-X Section 36.4.1, Figure 36.4,1, 1 page.
(Continued)

*Primary Examiner* — Daniel J Munoz
(74) *Attorney, Agent, or Firm* — Rothwell, Figg, Ernst & Manbeck, P.C.

(57) ABSTRACT

The invention provides an antenna arrangement having an operating frequency band with a mean wavelength λ and comprising at least two columns of antenna elements with at least two antenna elements in each column. Each column of antenna elements extends above a separate elongated column ground plane with a column separation defined as a distance between mid-points of neighbouring column ground planes. The antenna elements in each column are located along a column axis pointing in a longitudinal direction of the column ground plane wherein all column separations are below 0.9λ and wherein a parasitic element extends above at least one antenna element in each column. Parameters of the parasitic element are adapted for proper excitation thus achieving a reduced beamwidth for each of said columns of antennas. The invention also provides a method to manufacture the antenna arrangement.

19 Claims, 10 Drawing Sheets

(52) U.S. Cl.
CPC ..... *H01Q 21/062* (2013.01); *H01Q 21/26* (2013.01); *Y10T 29/49016* (2015.01)

(58) Field of Classification Search
USPC ..... 343/797, 798
See application file for complete search history.

(56) References Cited

U.S. PATENT DOCUMENTS

| | | | | |
|---|---|---|---|---|
| 2006/0139230 | A1* | 6/2006 | Shirosaka | H01Q 21/062 343/817 |
| 2007/0146225 | A1* | 6/2007 | Boss | H01Q 21/08 343/797 |
| 2009/0195471 | A1* | 8/2009 | Semonov | H01Q 1/246 343/810 |
| 2009/0267856 | A1 | 10/2009 | Schadler et al. | |
| 2012/0146872 | A1* | 6/2012 | Chainon | H01Q 1/523 343/818 |

OTHER PUBLICATIONS

SEO et al. "Design of Dual Polarized Antenna for DCS, UMTS, WiBro Base Stations" Wireless Information Technology and Systems (ICWITS), 2010 IEEE International Conference, 2010, 4 pages.

* cited by examiner

COMPACT MULTI-COLUMN ANTENNA

CROSS REFERENCE TO RELATED APPLICATION(S)

This application is a 35 U.S.C. § 371 National Phase Entry Application from PCT/EP2010/066568, filed Nov. 1, 2010, designated the United States, the disclosure of which is incorporated herein in its entirety by reference.

TECHNICAL FIELD

The present invention relates to the field of base station antennas used in wireless communication systems.

BACKGROUND

Base-station antennas for 3 sector systems shall typically have 65 degrees horizontal beamwidth for good coverage and small interference. This beamwidth can also be desirable in other configurations of base station antennas. The generic beamwidth of a single antenna element on a large ground plane is typically much larger, 80-100 degrees. FIG. 1 presents a perspective view of one of the antenna elements 101 in a single polarized base station antenna with one column over a reflector or ground plane 102. The base station antenna is located in a coordinate system with an x-axis 104, a y-axis 105 and a z-axis 106. The ground plane is mainly extending in a y/z-plane and the antenna element is extending in an antenna element plane being substantially a parallel y/z-plane with a different x-coordinate. Several antenna elements are located over the ground plane along a column axis 107 being parallel to the z-axis. The antenna elements are elongated dipoles with a longitudinal extension of the dipoles having an antenna element angle α in clockwise direction to the column axis 107 of 45 degrees. The beamwidth can be reduced to 65 degrees for the single polarized antenna of FIG. 1 and also for a standard dual-polarized base station antenna with one column by proper design of the reflector or ground plane width 103. The total width of such design is typically 0.9-1λ when the beamwidth is 65 degrees. λ denotes the average wavelength in the operating frequency band of the antenna. The elongated reflector or ground plane is extending in the direction of the z-axis as indicated by the dash dotted lines 108.

The difference between a single polarized antenna and a dual polarized antenna is the antenna element. In a single polarized antenna as shown in FIG. 1 the antenna element can typically be a single dipole element. In a dual polarized antenna the antenna element typically comprises two crossed dipoles with a 90 degree angle between the longitudinal extensions of the two dipoles.

Horizontal co-polarized farfield radiation patterns 203, henceforth in description and claims called the radiation pattern, in the frequency range from 1700 to 2200 MHz are shown in the diagram of FIG. 2*a* for the antenna arrangement of FIG. 1 with a reflector or ground plane width of 0.9λ and with one antenna element. In FIG. 2*a* amplitude is shown in dB on the vertical axis 201 and direction in degrees in relation to the x-axis on the horizontal axis 202. The radiation pattern has approximately rotational symmetry around the x-axis with the maximum field pointing in the positive direction of the x-axis, corresponding to zero degrees in FIG. 2*a*. The direction of 90 degrees thus corresponds to the radiation in the antenna element plane. Beamwidth 204 is shown in FIG. 2*b* for the antenna arrangement of FIG. 1 with one antenna element and with a 0.9λ wide reflector or ground plane 102 with beamwidth in degrees on the vertical axis 205 and frequency in MHz on the horizontal axis 206. The radiation pattern shows a beamwidth in the 65-70 degree interval. The diagrams of FIG. 2 are valid either for a single polarized antenna or for each of the polarizations from a dual polarized antenna.

For smaller reflector or ground plane widths it is not possible to achieve a 65 degree beamwidth. FIGS. 3*a* and 3*b* presents typical results for a 0.7λ wide reflector or ground plane and with the antenna arrangement of FIG. 1 with one antenna element. The radiation patterns 303 in the frequency range from 1700 to 2200 MHz are shown in the diagram in FIG. 3*a* having amplitude in dB on the vertical axis 301 and direction in degrees in relation to the x-axis on the horizontal axis 302 in the same way as described for FIG. 2*a*. Beamwidth 304 is shown in FIG. 3*b* for a 0.7λ wide reflector or ground plane 102 with beamwidth in degrees on the vertical axis 305 and frequency in MHz on the horizontal axis 306. The radiation pattern shows a beamwidth in the 75-80 degree interval.

In typical base station antennas several columns in parallel are normally used in order to improve possibilities for digital beam forming and use of the Multiple Input Multiple Output (MIMO) principle.

When using digital beam forming, which is a well know technology for the skilled person, the beam of the antenna is directed or scanned in different directions by e.g. feeding the transmitted signal to the antenna elements with different time delays.

FIG. 4 shows a perspective view of a one antenna element section of a 4-column antenna with a first 401, a second 402, a third 403 and a fourth 404 column. The antenna is located in a coordinate system with an x-axis 405, a y-axis 406 and a z-axis 407. Each antenna element 408 in a column is extending in a plane substantially in parallel with a separate column ground plane 409 for each column. The ground planes are mainly extending in a y/z-plane. A column separation 410 is defined as the distance between midpoints 413 of neighboring column ground planes 409. A ground plane separation 411 is defined as the separation between neighboring ground planes and a column width 412 is defined as the width of a column ground plane. Each column ground plane is elongated and has a longitudinal extension in the direction of the z-axis 407. The longitudinal extensions of the different ground planes are typically substantially in parallel. The ground plane separation 411 is normally very short compared to the column width 412, which means that the column separation 410 normally is about the same as the column width 412.

Dash dotted lines 414 in the forth column 404 schematically indicates how the elongated column ground planes are extending in the direction of the z-axis. Antenna elements are extending above the column ground planes as explained in association with FIG. 1.

The column separation of multi-column antennas is a critical parameter which is subject to several conflicting requirements:

- Antenna size
  - Smaller column separation results in a smaller antenna with less visual impact and wind load.
- Grating lobes during beamscan
  - 0.5λ column separation enables large scan angles without any grating lobes
  - 1.0λ column separation gives grating lobes for moderate scan angles
- Correlation
  - Larger column separation decrease correlation which improves MIMO qualities.
- Antenna beamwidth
  - From a network perspective (assuming e.g. 3-sector sites) 65 degree beamwidth is preferred.

Grating lobes are side lobes dependent on the antenna element spacing in array antennas. The amplitude of the grating lobe can be comparable to the main lobe when the beam is scanned for antenna element spacings larger than 0.5λ. In this case the antenna element corresponds to one column of antenna elements and the spacing between antenna elements corresponds to the column separation.

To meet the requirement to have a narrower beam, around 65 degrees, for each column in a multi-column antenna and simultaneously a compact antenna, the same considerations apply as described for a single column antenna in association with FIGS. 1-3 except that the column width parameter now is replaced by the column separation parameter. This has the consequence that, by using existing technology, it is not possible to achieve a 65 degree beamwidth for column separations smaller than 0.9λ. For example, an antenna with a 65 degree beam having a 0.7λ column separation is not possible.

There is thus a need for a multi-column antenna with a narrower beamwidth and simultaneously having a narrower column separation than the prior art solutions of today.

SUMMARY

The object of the invention is to reduce at least some of the mentioned deficiencies with the prior art solution and to provide:

an antenna arrangement and a method to provide an antenna arrangement to solve the problem to achieve a multi-column antenna with a narrower beamwidth and simultaneously having a narrower column separation.

The object is achieved by providing an antenna arrangement having an operating frequency band with a mean wavelength λ and comprising at least two columns of antenna elements with at least two antenna elements in each column. Each column of antenna elements extends above a separate elongated column ground plane with a column separation defined as a distance between midpoints of neighbouring column ground planes. The antenna elements in each column are located along a column axis pointing in a longitudinal direction of the column ground plane wherein all column separations are below 0.9λ and wherein a parasitic element extends above at least one antenna element in each column. The shape and dimensions of the parasitic element and the height of the parasitic element above the antenna element and above the column ground plane is adapted for proper excitation thus achieving a reduced beamwidth for each of said columns of antennas.

The object is further achieved by providing a method to manufacture the antenna arrangement having an operating frequency band with a mean wavelength λ and having at least two columns of antenna elements with at least two antenna elements in each column. Each column of antenna elements extends above a separate elongated column ground plane with a column separation defined as a distance between midpoints of neighbouring column ground planes. The antenna elements in each column are located along a column axis pointing in a longitudinal direction of the column ground plane wherein:

- all column separations are arranged to be below 0.9λ
- a parasitic element is located to extend above at least one antenna element in each column,
- the parasitic element is properly excited by adjusting the shape and dimensions of the parasitic element and the height of the parasitic element above its antenna element and above the column ground plane thus achieving a reduced beamwidth for each of said columns of antennas.

Additional advantages are achieved by implementing one or several of the features of the dependent claims, as will be explained below.

DETAILED DESCRIPTION

The invention will now be described with reference to the enclosed drawings, FIGS. 5-10. FIGS. 1-4 are explained in association with the Background part. All reference numbers in the figures are three or four digit numbers with the thousands and hundreds digit corresponding to the figure number.

Figure 4:
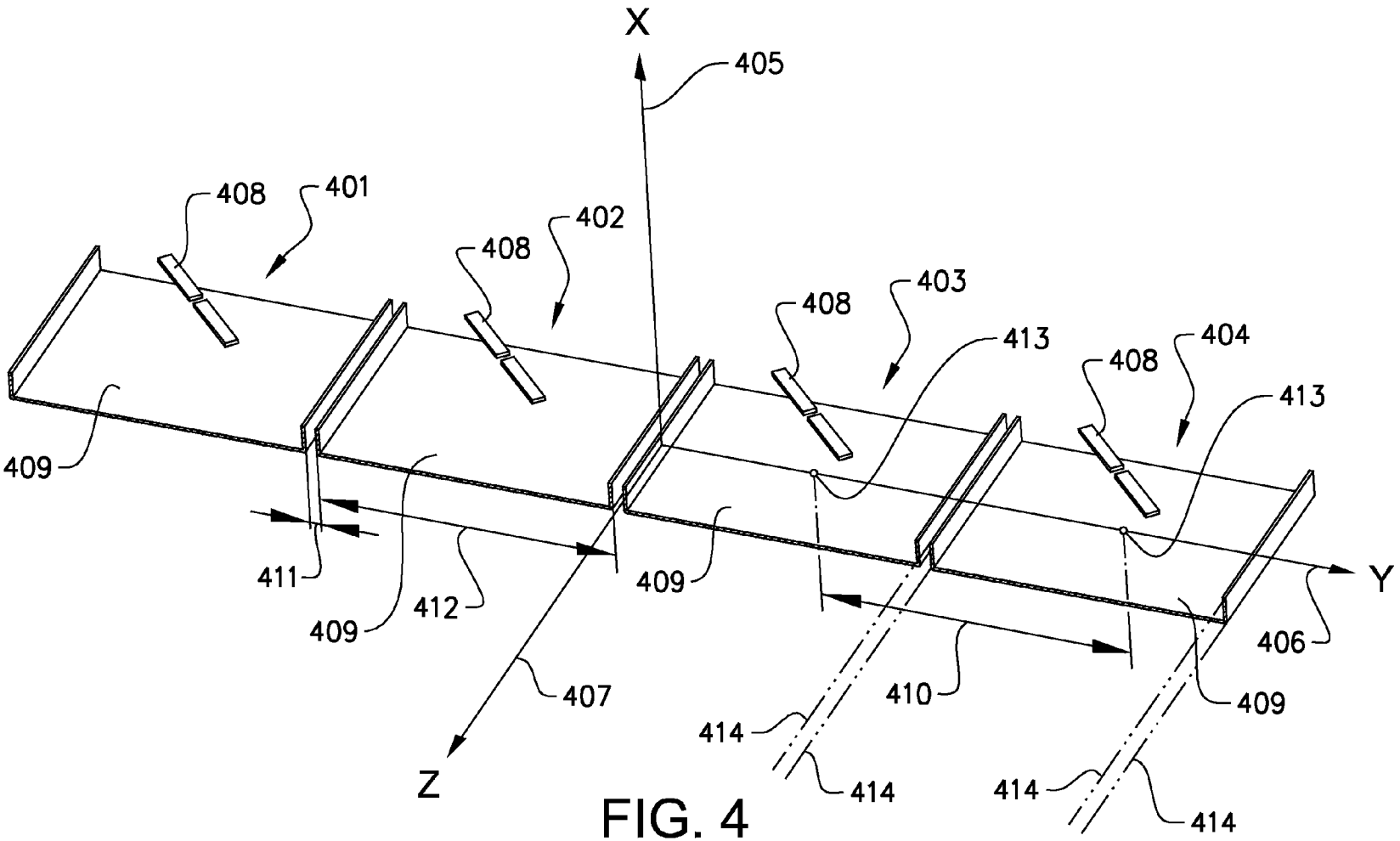
FIG. 4 schematically shows in perspective view one row of antenna elements in a four column antenna according to a prior art solution.

For clarity reasons the invention is described with figures showing only one antenna element in one column. For multi-column solutions, the columns and antenna elements are configured as shown in FIG. 4 and the parameter column separation is used instead of column width.

The antenna arrangement of the invention has an operating frequency band with a mean wavelength λ and comprises at least two columns 401-404 of antenna elements 101, 408, 501, 801 with at least two antenna elements in each column. Each column of antenna elements extends above a separate elongated column ground plane 409, 502, 802 with a column separation, 410 defined as a distance between midpoints, 413, of neighbouring column ground planes. The antenna elements in each column are located along a column axis 107, 507, 808 pointing in a longitudinal direction of the column ground plane, 409, 502, 802. Column ground planes, column axes and antenna elements will be further illustrated and explained in association with FIGS. 5 and 8.

Figure 5A:
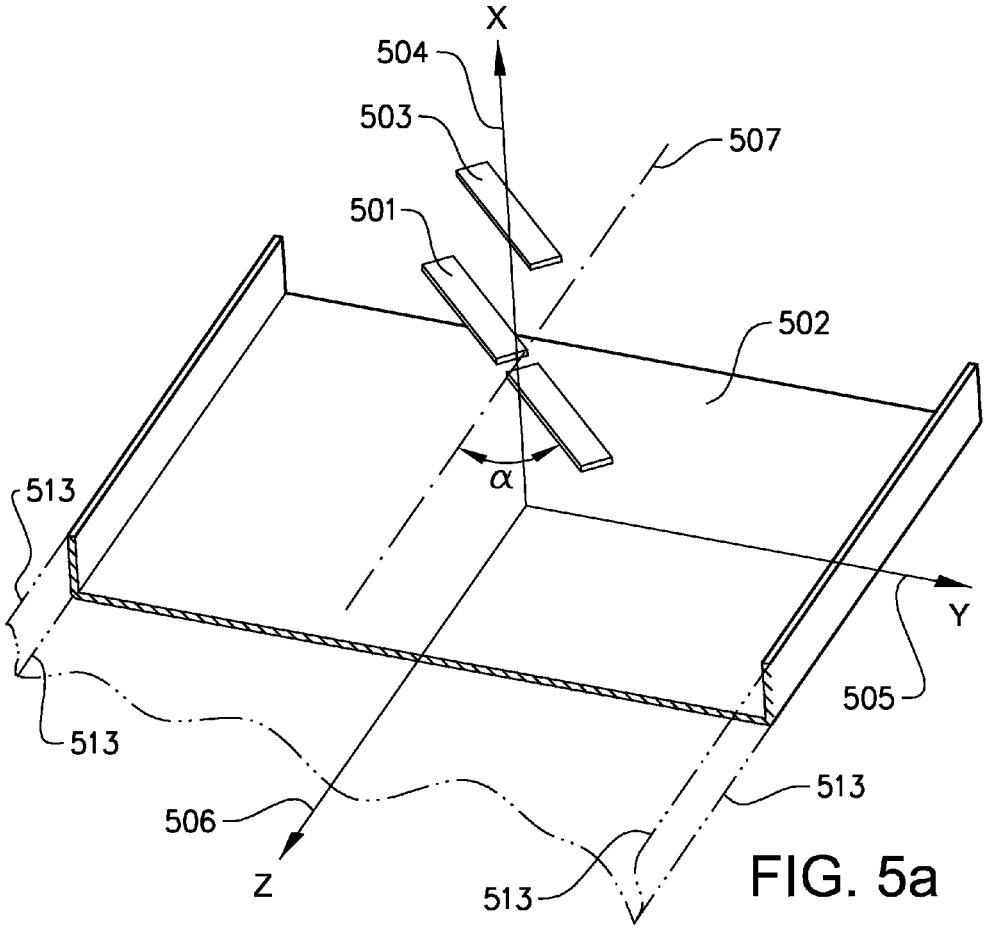
FIG. 5*a* schematically shows in perspective view a dipole with a parasitic element above a wide ground plane.

FIG. 5*a* shows an example of an antenna arrangement with a second antenna element, also called a parasitic element 503, added above the antenna element 501 according to the invention. Instead of using the antenna width as a method to generate the narrow beam, the invention makes use of the height dimension by adding the parasitic element. The parasitic element is excited by capacitive coupling from the antenna element, in this case a dipole antenna, and the effective antenna pattern is generated by an antenna array comprising the parasitic elements and the antenna elements. Proper selection of length of the parasitic element and height of the parasitic element above the antenna element and above a very wide, theoretically an infinite, column ground plane 502 makes it possible to obtain a proper excitation which reduces the beamwidth of the radiation pattern. The antenna is illustrated in a coordinate system with an x-axis 504, a y-axis 505 and a z-axis 506. The column axis 507 in the example of FIG. 5 is extending in the direction of the z-axis. The antenna element angle α is the angle in clockwise direction towards the column axis and is in this example 45 degrees. The column ground plane 502 extends mainly in the y/z-plane in the direction of the z-axis as indicated by the dash dotted lines 513. Antenna elements are extending above the column ground plane as explained in association with FIG. 1.

For single polarized antennas the antenna element can be realized with e.g. a dipole antenna or a patch antenna, both well known antenna types for the skilled person. When a dipole antenna or a patch is used as the antenna element the parasitic element is typically a stripe with a shape corresponding to a dipole antenna. There is however a considerable degree of freedom in selecting the shape and dimensions of the parasitic element as is well known to the skilled person. Other types of antenna elements as e.g. a bow-tie are also possible to use within the scope of the invention.

Figure 5B:
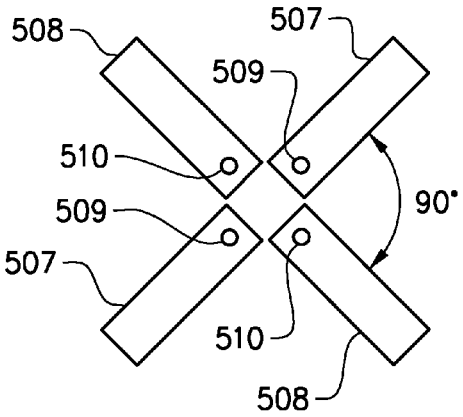
FIG. 5*b* schematically shows feeding of a dual polarized antenna element.
Figure 5C:
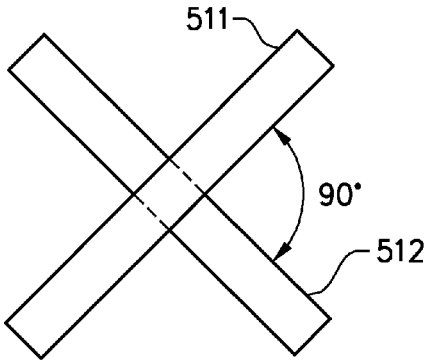
FIG. 5*c* schematically shows a parasitic element suitable for a dual polarized antenna element.

For dual polarized antennas, see FIG. 5*b*, the antenna element can be realized with a crossed dipole comprising a first 507 and a second 508 dipole with a 90 degree angle between the longitudinal extensions of the two dipoles. The first dipole is fed at first two feeding points 509 and the second dipole is fed at second two feeding points 510. When this type of antenna element is used the parasitic element typically has a corresponding cross configuration with a first 511 and a second 512 crossed stripe with a 90 degree angle between the longitudinal extensions of the two stripes. The stripes can be isolated from each other or galvanically connected. A patch can also be used as an antenna element for dual polarization as is well known to the skilled person. The parasitic element can in this case also have the cross configuration described above.

As is well known to the skilled person and as shown in FIG. 5*b* a dipole comprises two parts of equal length with a gap between the two parts. Each dipole part has a feeding point at the end towards the gap. Typically the total length of the two parts comprising the dipole is λ/2, λ being the mean wavelength in the operating frequency band of the dipole. This type of dipole is called a half-wave dipole.

Figure 6A:
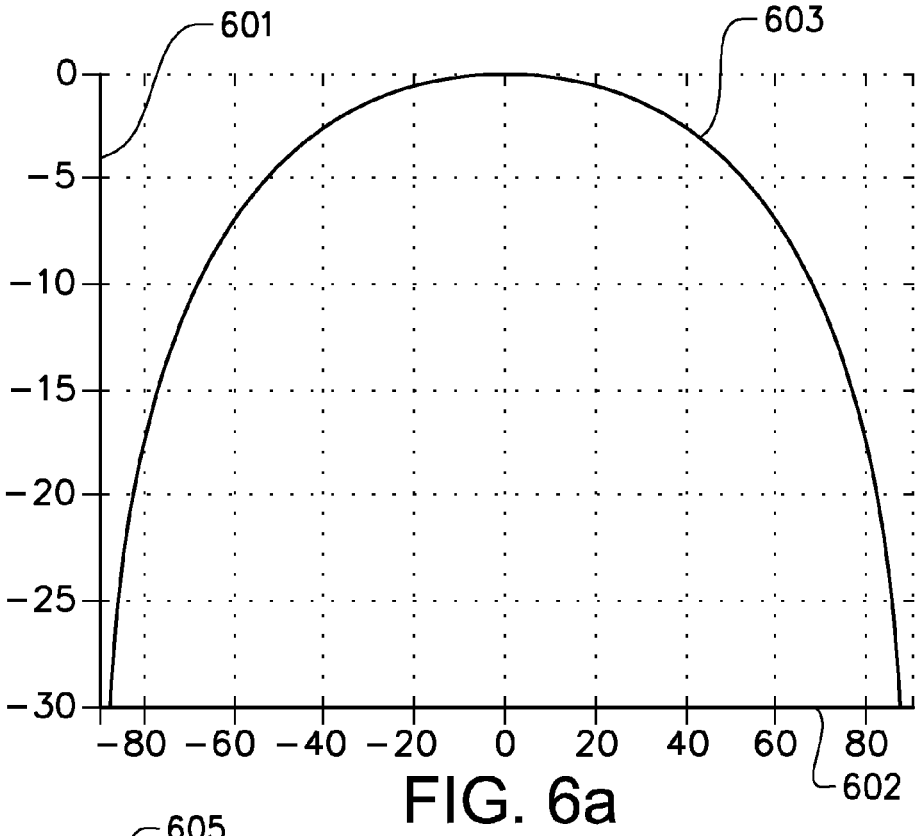
FIG. 6*a* shows a diagram with radiation patterns for a dipole antenna with a not excited parasitic element above a wide ground plane.
Figure 6B:
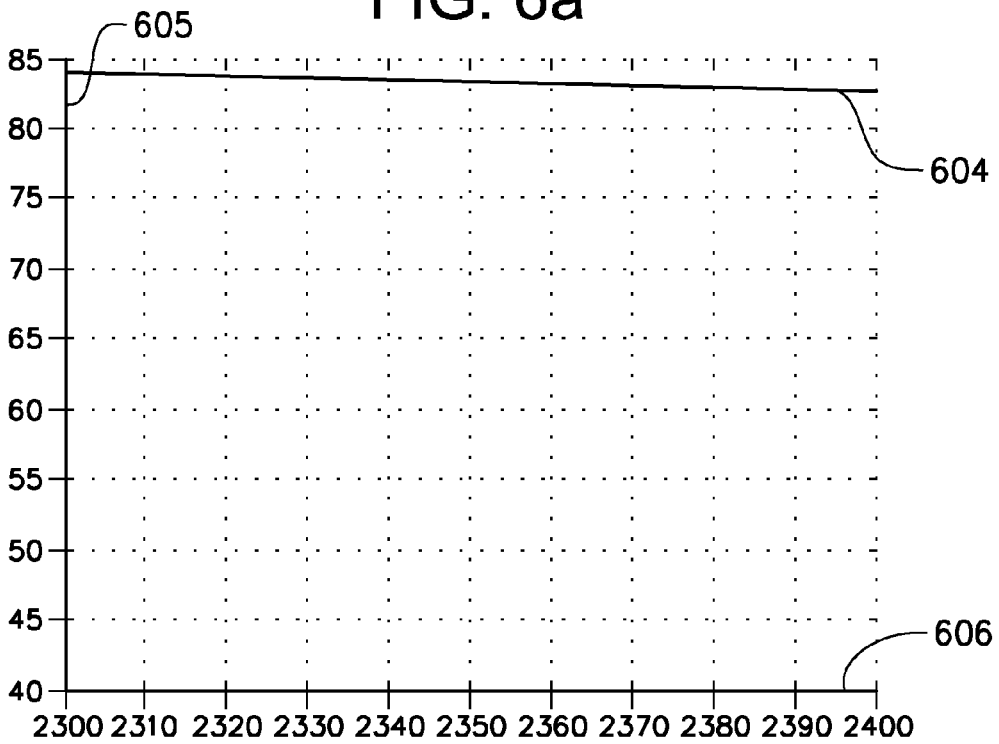
FIG. 6*b* shows a diagram with beamwidth as a function of frequency for a dipole antenna with a not excited parasitic element above a wide ground plane.

FIG. 6*a* presents the radiation pattern and FIG. 6*b* corresponding beamwidth for the antenna arrangement of FIG. 5 with one antenna element when the dimensions of the parasitic element are chosen far from being properly excited. The radiation patterns in the frequency range from 2300 to 2500 MHz are shown in the diagram in FIG. 6*a* having amplitude in dB on the vertical axis 601 and direction in degrees on the horizontal axis 602 in the same way as described for FIG. 2*a*. As the radiation patterns for different frequencies almost coincide with each other in this case, they are drawn as one graph 603. The radiation pattern is in this example equal to the pattern of the dipole antenna element itself (without parasitic element) as the parasitic element is not excited and does thus not contribute to the radiation. As can be seen in FIG. 6*a* the radiation is almost zero in the antenna element plane, corresponding to 90 degrees, which is characteristic for a dipole antenna.

Beamwidth 604 corresponding to the radiation pattern of FIG. 6*a* is shown in FIG. 6*b* with beamwidth in degrees on the vertical axis 605 and frequency in MHz on the horizontal axis 606. The radiation pattern shows a beamwidth in the 85-80 degree interval in the frequency range 2300-2400 MHz. The diagrams of FIG. 6 are valid either for a single polarized antenna or for each of the polarizations from a dual polarized antenna.

By proper excitation of the parasitic element by selecting the height of the parasitic element above the antenna element and above the ground plane and by selecting the shape and dimensions of the parasitic element it is possible to reduce the beamwidth as will be illustrated in FIG. 7.

Figure 7A:
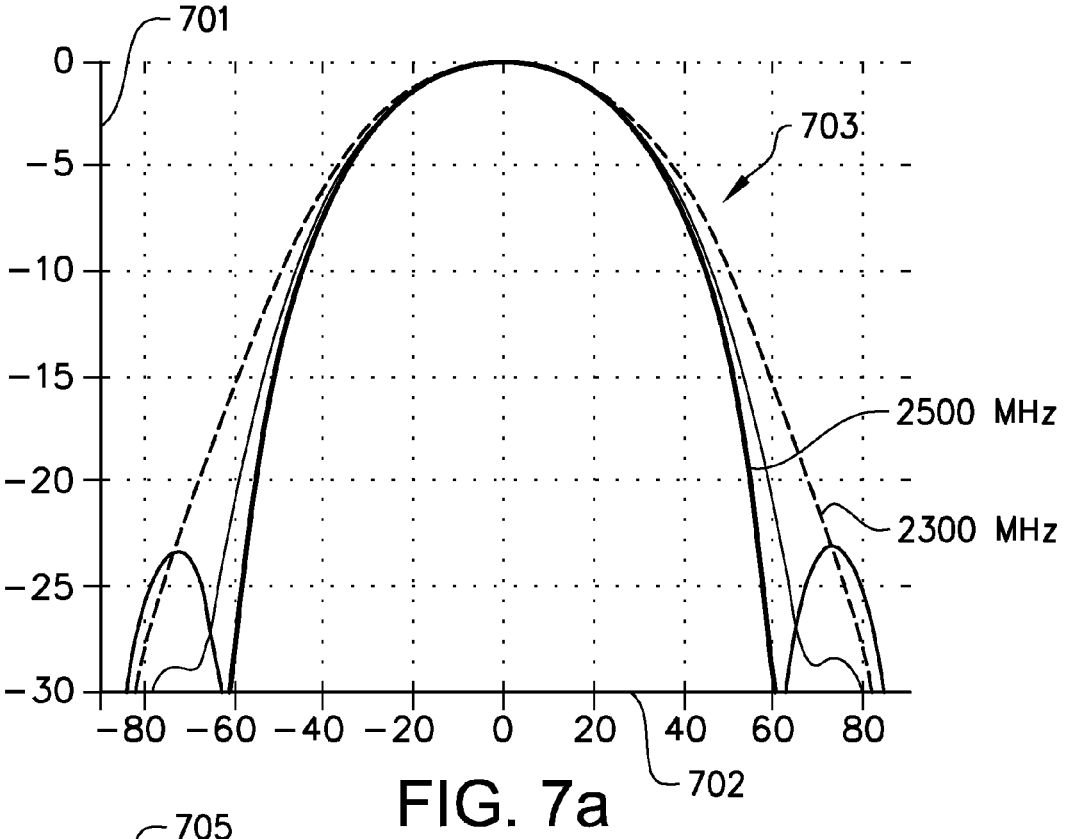
FIG. 7*a* shows a diagram with radiation patterns for different frequencies for a dipole antenna with a properly excited parasitic element above a wide ground plane.
Figure 7B:
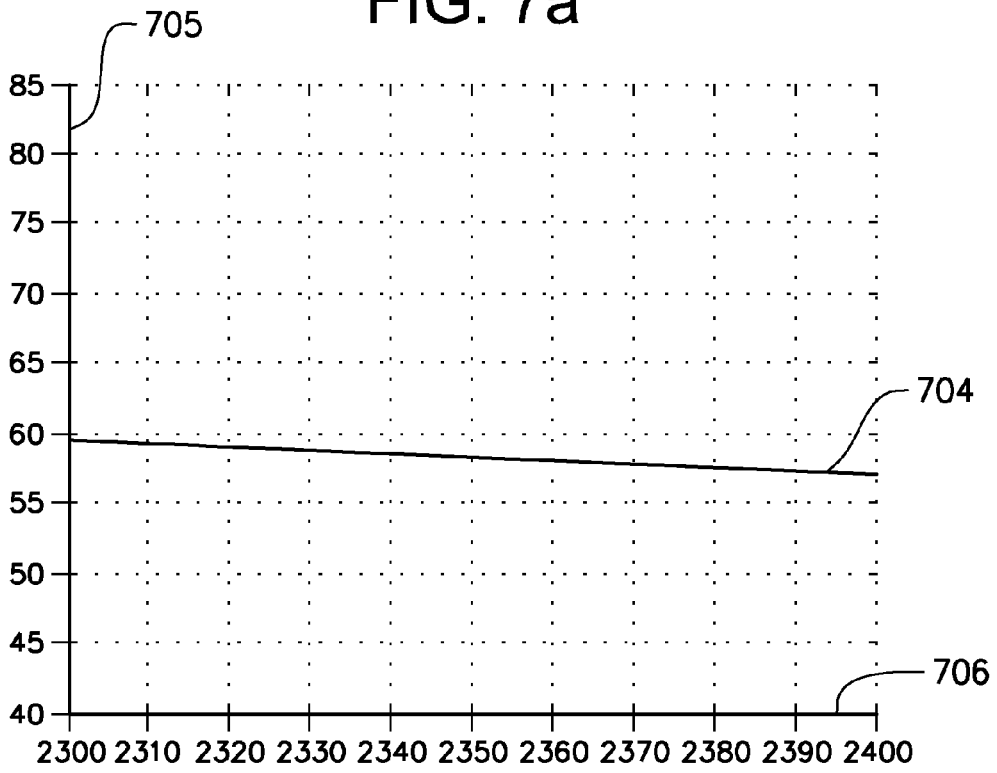
FIG. 7*b* shows a diagram with beamwidth as a function of frequency for a dipole antenna with a properly excited parasitic element above a wide ground plane.

FIG. 7*a* presents the radiation pattern and FIG. 7*b* corresponding beamwidth for the antenna arrangement of FIG. 5 with a wide ground plane and one antenna element when the parasitic element is properly excited by selection of dimensions and location of the parasitic element. The radiation patterns 703 in the frequency range from 2300 to 2500 MHz are shown in the diagram in FIG. 7*a* having amplitude in dB on the vertical axis 701 and direction in degrees on the horizontal axis 702 in the same way as described for FIG. 2*a*.

Beamwidth 704 is shown in FIG. 7*b* with beamwidth in degrees on the vertical axis 705 and frequency in MHz on the horizontal axis 706. The radiation pattern shows a beamwidth in the 60-55 degree interval in the frequency range 2300-2400 MHz. The diagrams of FIG. 7 are valid either for a single polarized antenna or for each of the polarizations from a dual polarized antenna.

A comparison between FIGS. 6 and 7 clearly shows how the beamwidth becomes narrower when the parasitic element is properly excited. In this case the beamwidth is reduced from around 80 to 60 degrees. This principle of reducing the beamwidth by a parasitic element is scalable also to other frequencies than used in the examples presented in this description.

The beamwidth in this description is defined as the width in degrees of the main beam in the radiation pattern between the 3 dB points. At a 3 dB point the signal power of the main beam has been reduced to half of the value of the power in the direction of maximum radiation.

Figure 8:
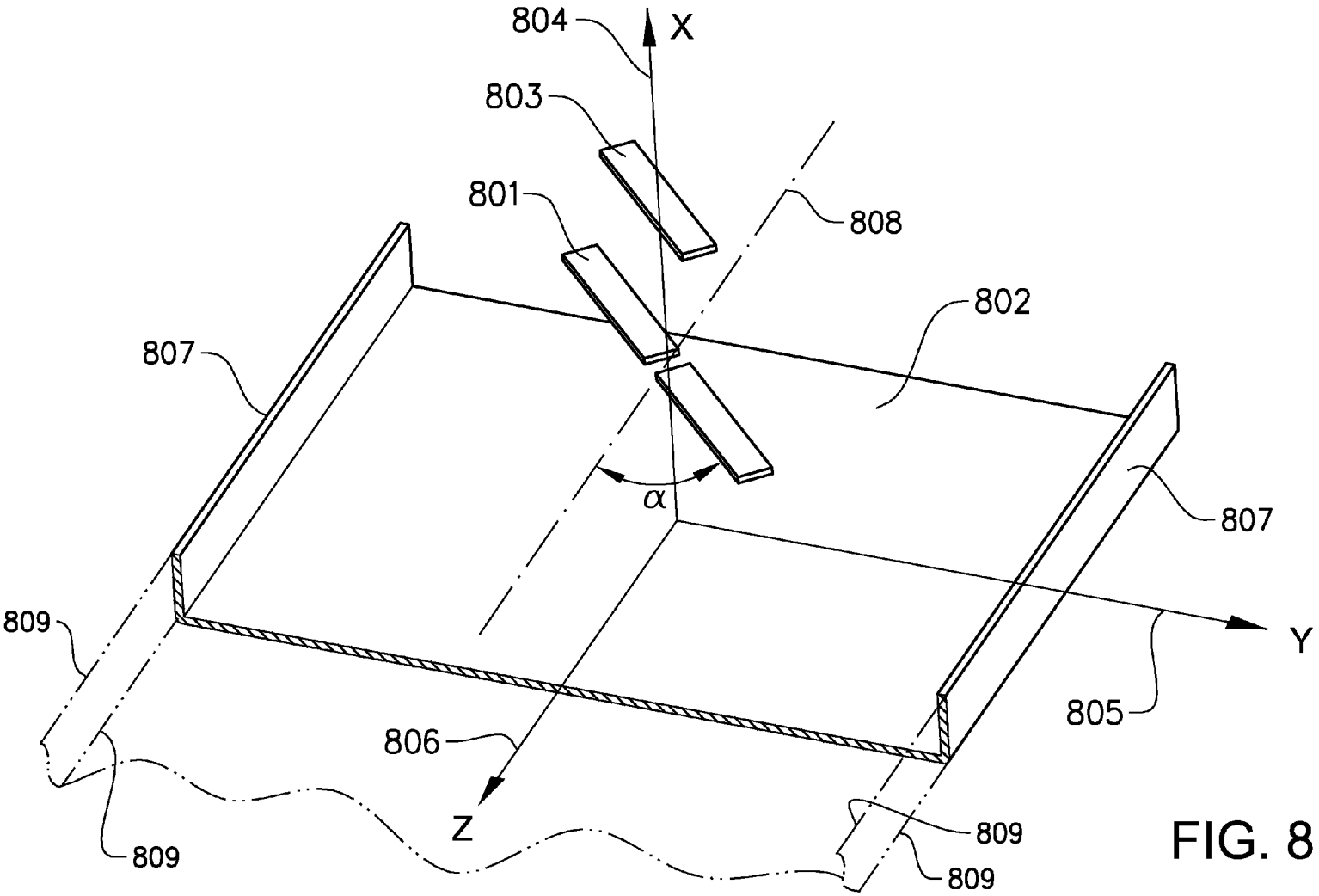
FIG. 8 schematically shows in perspective view an example of the invention with a dipole antenna and a properly excited parasitic element over a 0.7λ wide ground plane.

FIG. 8 shows an example of the invention with the second antenna element, also called the parasitic element 803, added above the antenna element 801. The parasitic element is excited by capacitive coupling from the antenna element, in this case a dipole antenna with a total length of λ/2, and the effective antenna pattern for one complete column corresponds to the average pattern of the antenna elements with parasitic elements included in the column. Proper selection of length of the parasitic element and height of the parasitic element above the antenna element and above a column ground plane 802 makes it possible to obtain a proper excitation which reduces the beamwidth of the radiation pattern. The antenna is illustrated in a coordinate system with an x-axis 804, a y-axis 805 and a z-axis 806. As the antenna element in this case is a dipole antenna, the parasitic element has a corresponding shape of a stripe of conductive material of a certain length.

FIG. 8 and also FIG. 5 show only one antenna element in one column. For multi-column solutions, as explained earlier, the columns and antenna elements are configured as shown in FIG. 4 and the parameter column separation is used instead of column width. For multi-column solutions with several antenna elements in each column it is not necessary that parasitic elements are extending above all antenna elements in each column. As the effective antenna pattern for one complete column corresponds to the average pattern of the antenna elements with and without the parasitic elements included in the column it can typically be sufficient, when the antenna arrangement comprises at least two columns 401-404 of antenna elements 801, to have parasitic elements extending over 50-70 percent of the antenna elements in each column in order to achieve the desired beamwidth.

The radiation patterns and beamwidths in FIGS. 2, 3, 6 and 7 are shown for antenna arrangements with one column and one antenna element. The antenna gain is increased with the number of antenna elements in a column and the MIMO/beamforming capabilities are improved with an increased number of columns. For the antenna arrangement of the invention there are at least two columns with at least two antenna elements in each column.

Figure 1:
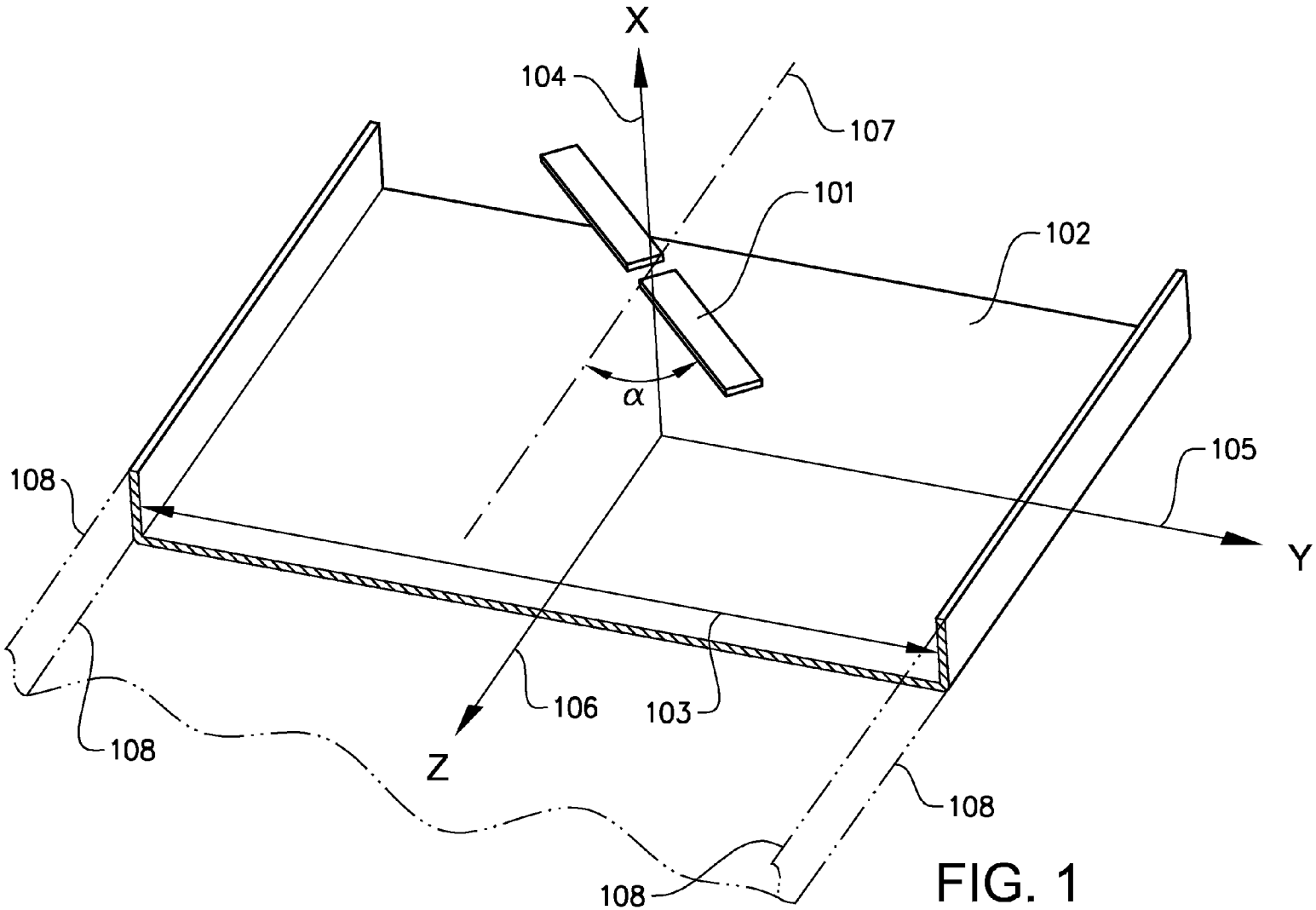
FIG. 1 schematically shows a perspective view of a single antenna element above a 0.9λ wide reflector or ground plane according to prior art.
Figure 2A:
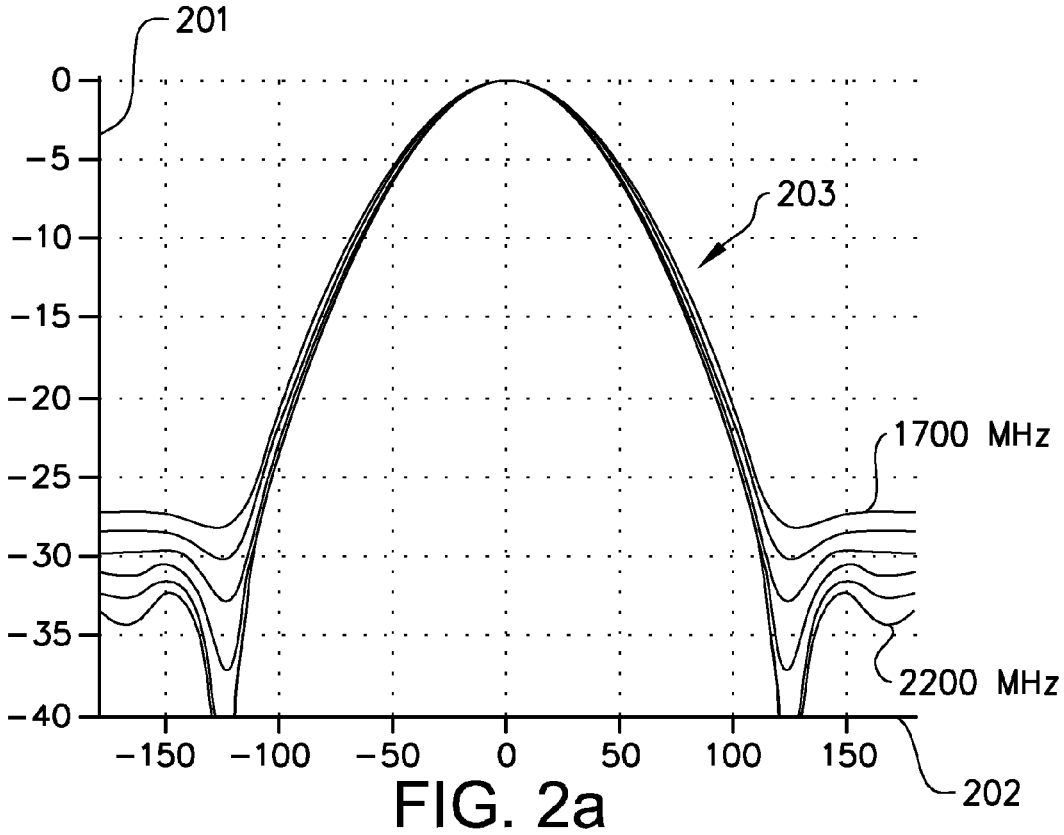
FIG. 2*a* shows a diagram with radiation patterns for different frequencies for an antenna element above a 0.9λ wide reflector or ground plane according to prior art.
Figure 2B:
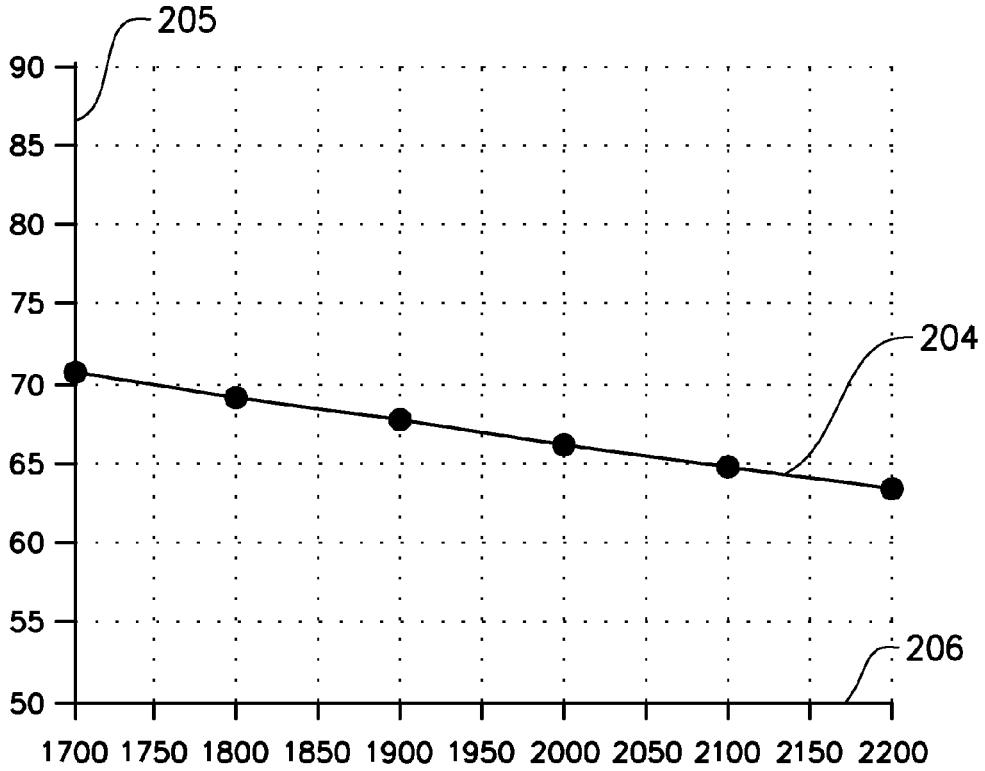
FIG. 2*b* shows a diagram with beamwidth as a function of frequency for an antenna element above a 0.9λ wide reflector or ground plane according to prior art.

FIG. 8 also illustrates that narrow portions 807 of each column ground plane 802 along the longitudinal edges are folded out of the column ground plane and towards the antenna elements 801. This "folding out" feature of the ground plane is used to fine tune the antenna pattern. These narrow portions of the column ground planes are also shown in FIGS. 1, 4 and 5 and explain why the ground planes and column ground planes are said to extend mainly in the y/z-plane.

The column axis 808 is extending in the direction of the longitudinal extension of the column ground plane which in the example of FIG. 8 corresponds to the z-axis. The antenna element angle α, being the angle in clockwise direction towards the column axis, is in this example 45 degrees.

The column ground plane 802 extends mainly in the y/z-plane in the direction of the z-axis as indicated by the dash dotted lines 809. Antenna elements are extending above the column ground plane as explained in association with FIG. 1.

Figure 3A:
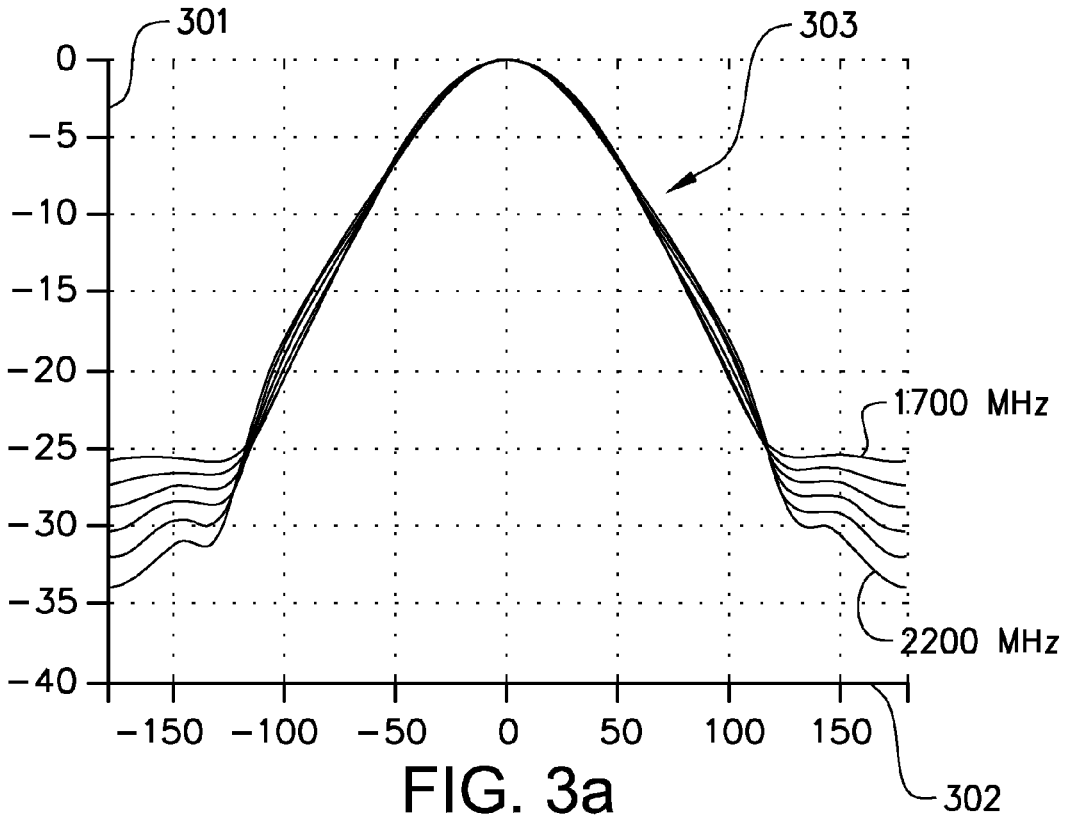
FIG. 3*a* shows a diagram with radiation patterns for different frequencies for an antenna element above a 0.7λ wide reflector or ground plane according to prior art.
Figure 3B:
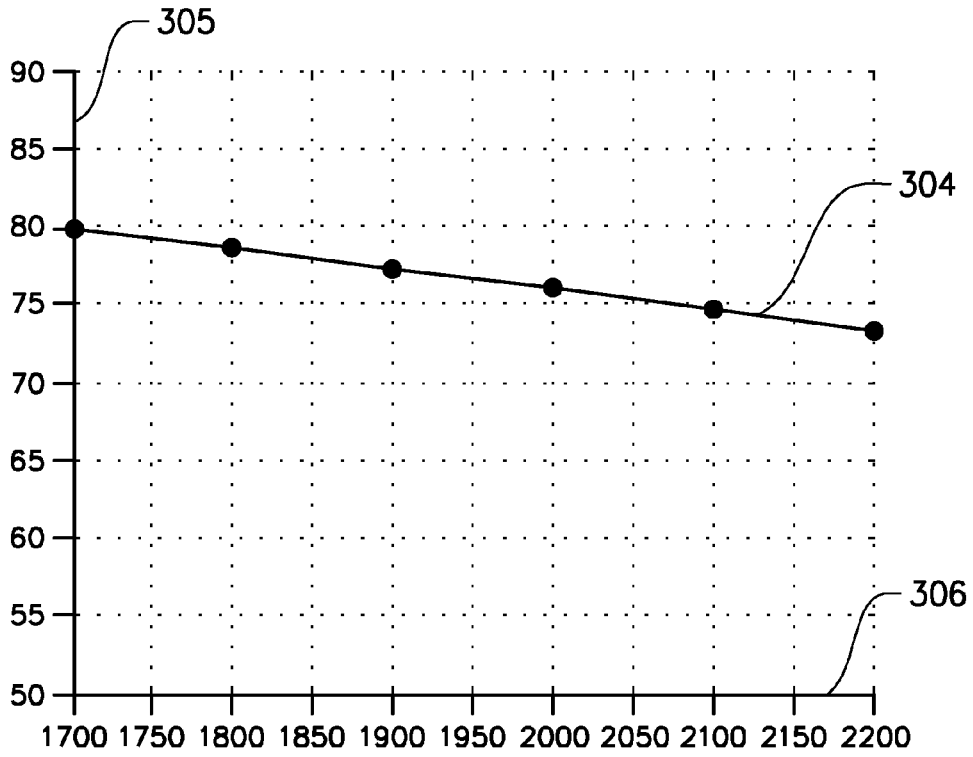
FIG. 3*b* shows a diagram with beamwidth as a function of frequency for an antenna element above a 0.7λ wide reflector or ground plane according to prior art.
Figure 9:
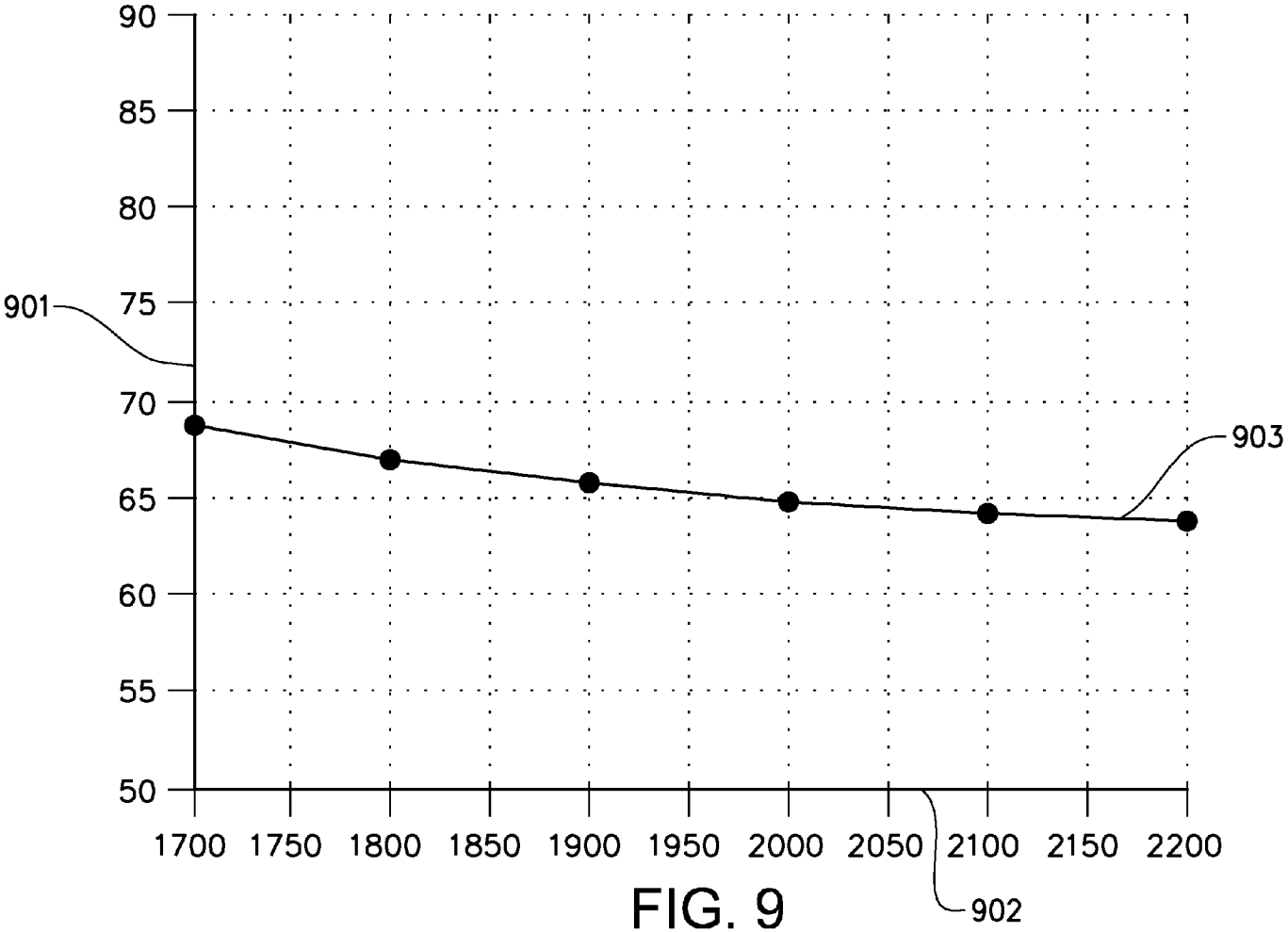
FIG. 9 shows a diagram with beamwidth as a function of frequency for a dipole antenna with a properly excited parasitic element over a 0.7λ wide ground plane according to an example of the invention.

FIG. 9 presents, for the antenna arrangement according to FIG. 8 with one antenna element, the effects of the parasitic element using a 0.7λ wide column ground plane corresponding to a column separation 410 of 0.7λ for a multi-column antenna arrangement. Beamwidth 903 is shown as a function of frequency in the frequency range 1700-2200 MHz with beamwidth in degrees on the vertical axis 901 and frequency in MHz on the horizontal axis 902. The results can be compared with FIG. 3 showing the result for the same antenna configuration as in FIG. 9, but without the parasitic element. As can be seen, the beamwidth 903 of FIG. 9 is significantly narrower, around 65 degrees, than the beamwidth of FIG. 3 showing 75-80 degrees. The following parasitic parameter values have been used for the example of FIG. 9:

Parasitic element height above dipole: 0.25λ

Parasitic element height above ground plane: 0.5λ

Parasitic element length: 0.4λ

These are typical values for proper excitation. The dimensions and shape of the parasitic element as well as the two height parameters can vary within wide ranges in order to obtain proper excitation. This is a well know fact to the skilled person and therefore not further discussed here.

In the example of FIGS. 8 and 9 the column separation is 0.7λ. In general all column separations 410 shall be below 0.9λ and a parasitic element 803 extends above at least one antenna element 801 in each column 401-404. The shape and dimensions of the parasitic element 803 and the height of the parasitic element above the antenna element and above the column ground plane 802 is adapted for proper excitation thus achieving a reduced beamwidth for each of said columns of antennas.

The antenna elements 801 are located in the antenna element plane being substantially parallel to the column ground planes 802.

The parasitic elements 803 are located in a parasitic element plane being substantially parallel to the antenna element plane.

The antenna elements 801 are, as described, elongated dipoles located in the antenna element plane with a longitudinal extension of the dipoles having an antenna element angle α in clockwise direction to the column axis 808, thus achieving a single polarized antenna arrangement. Alternatively each antenna element 801 comprises two crossed elongated dipoles 507, 508 located in the antenna element plane with an angle of 90 degrees between the longitudinal extension of the two dipoles and with a longitudinal extension of one of the crossed dipoles having an antenna element angle α in clockwise direction to the column axis 808, thus achieving a dual polarized antenna arrangement.

The antenna element angle α can be arbitrary but in typical examples of the invention the antenna element angle α is equal to 45, 0, 135 or 90 degrees.

Normally all column separations 410 are identical and/or all column axis are substantially in parallel.

In summary when the column separation 410 is within the range 0.5λ-0.8λ and the parasitic elements 803 are adapted for proper excitation, the beamwidth 903 for all polarizations in each column 401-404 of antenna elements is within a range 55-75 degrees when the number of parasitic elements in each column is selected to achieve a beamwidth 903 within the range.

In a preferred example of the invention when the column separation 410 is substantially 0.7λ and the parasitic elements 803 are adapted for proper excitation, the beamwidth 903 for all polarizations in each column of antenna elements is substantially 65 degrees.

The invention also provides a method to manufacture the antenna arrangement having an operating frequency band with a mean wavelength λ and having at least two columns 401-404 of antenna elements 101, 408, 501, 801 with at least two antenna elements in each column. Each column of antenna elements extends above a separate elongated column ground plane 409, 502, 802 with a column separation 410 defined as a distance between midpoints 413 of neighbouring column ground planes 409, 502, 802. The antenna elements in each column are located along a column axis 107, 507, 808 pointing in a longitudinal direction of the column ground plane 409, 502, 802, wherein the method comprises the steps of:

arranging 1001 for all column separations 410 to be below 0.9λ locating 1002 a parasitic element 803 to extend above at least one antenna element 801 in each column, properly exciting 1003 the parasitic element 803 by adjusting the shape and dimensions of the parasitic element and the height of the parasitic element above its antenna element 801 and above the column ground plane 802 thus achieving a reduced beamwidth 903 for each of said columns of antennas.

Figure 10:
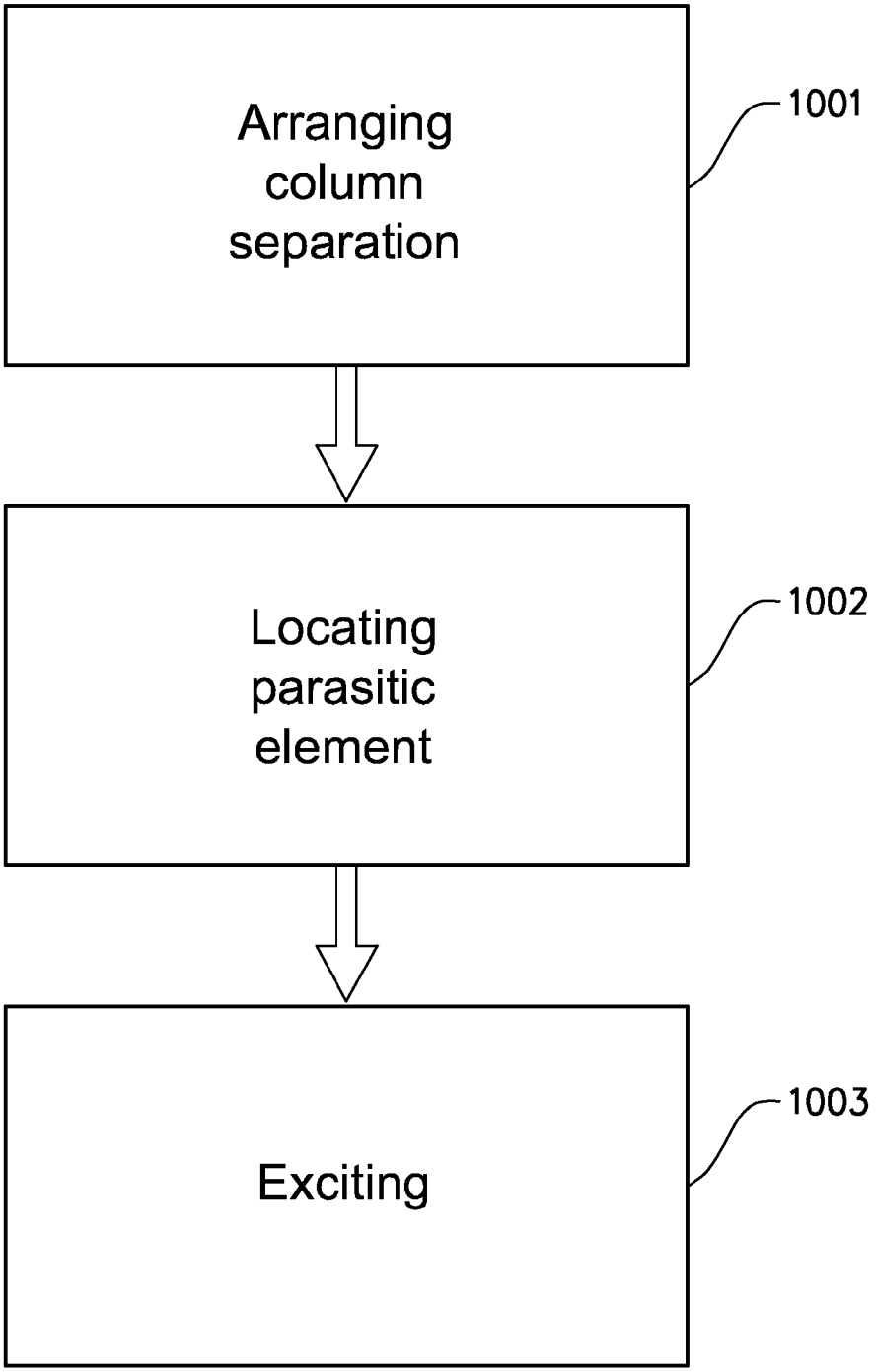
FIG. 10 shows a blockdiagram of an example of the method of the invention to manufacture a multi-column antenna arrangement.

An example of the method of the invention is schematically illustrated with a blockdiagram in FIG. 10 showing the three steps mentioned above of arranging, 1001, column separation, locating, 1002, parasitic elements above antenna elements and properly exciting, 1003, the parasitic elements. The steps do not necessarily have to be performed in the order as illustrated.

In one example of the method of the invention the antenna elements 801 are located in an antenna element plane being substantially parallel to the column ground planes 802.

In one example of the method of the invention the parasitic elements 803 are located in a parasitic element plane being substantially parallel to the antenna element plane.

In one example of the method of the invention the antenna elements 801 are located, the antenna elements being elongated dipoles, in the antenna element plane with a longitudinal extension of the dipoles having an antenna element angle α in clockwise direction to the column axis 808, thus achieving a single polarized antenna arrangement. Alternatively each antenna element 801 is located, the antenna element being two crossed elongated dipoles 507, 508, in the antenna element plane with an angle of 90 degrees between the longitudinal extension of the two dipoles and with a longitudinal extension of one of the crossed dipoles having an antenna element angle α in clockwise direction to the column axis 808, thus achieving a dual polarized antenna arrangement.

In one example of the method of the invention the antenna element angle α is 45, 0, 135 or 90 degrees.

In one example of the method of the invention all column separations 410 are made identical and/or all column axes 808 are arranged substantially in parallel.

In one example of the method of the invention when the column separation 410 is arranged to be within the range 0.5λ-0.8λ and the parasitic elements 803 are properly excited, the beamwidth 903 for all polarizations in each column 401-404 of antenna elements 801 is within a range 55-75 degrees when the number of parasitic elements in each column is selected to achieve a beamwidth within the range.

In one example of the method of the invention when the column separation 410 is arranged to be substantially 0.7λ, and the parasitic elements 803 are properly excited, the beamwidth 903 for all polarizations in each column 401-404 of antenna elements 801 is substantially 65 degrees.

The invention is described with examples of the antenna arrangement and corresponding method used in the frequency range 1.7-2.5 GHz. The inventive concept of the invention is however not restricted to these frequencies but can be used also for frequencies outside this range.

The invention is not limited to the embodiments and examples described above, but may vary freely within the scope of the appended claims.

The invention claimed is:

1. An antenna arrangement having an operating frequency band with a mean wavelength λ and comprising:

at least two columns of antenna elements with at least two antenna elements in each column, wherein:

each column of antenna elements extends above a separate one of a plurality of elongated column ground planes with a column separation defined as a distance between midpoints of neighbouring column ground planes, wherein all column separations are below 0.9 λ and greater than 0.5 λ, and wherein a surface of each of the neighboring column ground planes are in a same plane and separated by a gap, the antenna elements in each column are located along a column axis pointing in a longitudinal direction of the column ground plane, wherein edges along the longitudinal direction of the column ground plane are folded towards the antenna elements in each column; and parasitic elements that extend above at least one antenna element in each column, wherein the shape and dimensions of the parasitic elements and a height of the parasitic elements above the antenna elements and a height of the parasitic elements above the column ground planes are adapted for proper excitation of the parasitic elements to achieve a reduced beamwidth for each of said columns of antennas elements.

2. The antenna arrangement according to claim 1, wherein the antenna elements are located in an antenna element plane being substantially parallel to the column ground planes.

3. The antenna arrangement according to claim 2, wherein the parasitic elements are located in a parasitic element plane being substantially parallel to the antenna element plane.

4. The antenna arrangement according to claim 3, wherein the antenna elements are elongated dipoles located in the antenna element plane with a longitudinal extension of the dipoles having an antenna element angle α in clockwise direction to the column axis of the column ground planes, to achieve a single polarized antenna arrangement, or wherein each antenna element comprises two crossed elongated dipoles located in the antenna element plane with an angle of 90 degrees between the longitudinal extension of the two dipoles and with a longitudinal extension of one of the crossed dipoles having an antenna element angle α in clockwise direction to the column axis, to achieve a dual polarized antenna arrangement.

5. The antenna arrangement according to claim 4, wherein the antenna element angle α is equal to 45, 0, 135 or 90 degrees.

6. The antenna arrangement according to claim 1, wherein the antenna elements are patch antennas for single or dual polarization.

7. The antenna arrangement according to claim 1, wherein all column separations are identical and/or all column axes are substantially in parallel.

8. The antenna arrangement according to claim 1, wherein when the column separation is within the range 0.5λ-0.8λ and the parasitic elements are adapted for proper excitation, the beamwidth for all polarizations in each column of antenna elements is within a range 55-75 degrees when the number of parasitic elements in each column is selected to achieve a beamwidth within the range.

9. The antenna arrangement according to claim 8, wherein, when the column separation is substantially 0.7λ and the parasitic elements are adapted for proper excitation, the beamwidth for all polarizations in each column of antenna elements is substantially 65 degrees.

10. The antenna arrangement according to claim 1, wherein narrow portions of each column ground plane along the longitudinal edges are folded out of the column ground plane and towards the antenna elements.

11. The antenna arrangement according to claim 1, wherein the antenna arrangement comprises at least two columns of antenna elements with parasitic elements extending above 50-70 percent of the antenna elements in each column.

12. A method of manufacturing an antenna arrangement having an operating frequency band with a mean wavelength λ and comprising: at least two columns of antenna elements with at least two antenna elements in each column, each column of antenna elements extending above a separate one of a plurality of elongated column ground planes with a column separation defined as a distance between midpoints of neighbouring column ground planes, the antenna elements in each column being located along a column axis pointing in a longitudinal direction of the column ground plane; and parasitic elements, the method comprising:

arranging the at least two columns of antenna elements so that all column separations between neighbouring column ground planes are below 0.9 λ and greater than 0.5 λ, wherein edges along the longitudinal direction of each column ground plane are folded towards the antenna elements in each column, and wherein a surface of each of the neighbouring column ground planes are in a same plane and separated by a gap;

locating the parasitic elements above at least one antenna element in each column, wherein a shape of the parasitic elements, a height of the parasitic elements above the antenna elements, and a height of the parasitic elements above the column ground planes are adapted for proper excitation of the parasitic elements to achieve a reduced beamwidth for each of said columns of antenna elements.

13. The method according to claim 12, further comprising locating the antenna elements in an antenna element plane being substantially parallel to the column ground planes.

14. The method according to claim 13, further comprising locating the parasitic elements in a parasitic element plane being substantially parallel to the antenna element plane.

15. The method according to claim 14, wherein the antenna elements are elongated dipoles, in the antenna element plane with a longitudinal extension of the dipoles having an antenna element angle α in clockwise direction to the column axis, to achieve a single polarized antenna arrangement, or each of the antenna elements includes two crossed elongated dipoles, in the antenna element plane with an angle of 90 degrees between the longitudinal extension of the two dipoles and with a longitudinal extension of one of the crossed dipoles having an antenna element angle α in clockwise direction to the column axis, to achieve a dual polarized antenna arrangement.

16. The method according to claim 15, wherein the antenna element angle α is 45, 0, 135 or 90 degrees.

17. The method according to claim 12, further comprising making all column separations identical and/or arranging all column axes substantially in parallel.

18. The method according to claim 12, wherein the column separation is arranged to be within the range 0.5λ-0.8λ and the parasitic elements are properly excited and are adapted to cause the beamwidth for all polarizations in each column of antenna elements to be within a range 55-75 degrees when the number of parasitic elements in each column is selected to achieve a beamwidth within the range.

19. The method according to claim 18, wherein the column separation is arranged to be substantially 0.7λ and the parasitic elements are properly excited and are adapted to cause the beamwidth for all polarizations in each column of antenna elements to be substantially 65 degrees.

* * * * *